United States Patent [19]

Hunt, III

[11] 4,386,658

[45] Jun. 7, 1983

[54] SOLVENT PUSH-PULL PROCESS FOR IMPROVING VERTICAL CONFORMANCE OF STEAM DRIVE PROCESS

[75] Inventor: William C. Hunt, III, Dallas, Tex.

[73] Assignee: Mobil Oil Corporation, New York, N.Y.

[21] Appl. No.: 280,407

[22] Filed: Jul. 6, 1981

[51] Int. Cl.[3] ..... E21B 43/24

[52] U.S. Cl. ..... 166/263; 166/272

[58] Field of Search ..... 166/263, 272, 245, 252

[56] References Cited

U.S. PATENT DOCUMENTS

| | | | |
|---|---|---|---|
| 3,064,728 | 11/1962 | Gould | 166/263 X |
| 3,252,512 | 5/1966 | Baker et al. | 166/263 |
| 3,358,759 | 12/1967 | Parker | 166/263 |
| 4,166,502 | 9/1979 | Hall et al. | 166/245 X |
| 4,166,504 | 9/1979 | Brown et al. | 166/272 |

FOREIGN PATENT DOCUMENTS

| | | | |
|---|---|---|---|
| 1016862 | 9/1977 | Canada | 166/272 |

*Primary Examiner*—Stephen J. Novosad

*Attorney, Agent, or Firm*—Charles A. Huggett; James F. Powers, Jr.; Lawrence O. Miller

[57] ABSTRACT

The vertical conformance of a steam drive process is improved and steam override reduced by utilizing a solvent push-pull process in the lower portion of the formation adjacent the production well. Steam is injected into the injection well with production of fluids from the production well. The production well contains two flow paths from the surface, the first being in fluid communication with the upper portion of the formation. Production is continued until there is a water breakthrough from the formation via the first flow path in the production well. After production via the production well is terminated, a predetermined amount of solvent is injected into the lower portion of the formation via the second flow path in the production well while continuing to inject steam into the injection well. After the slug of solvent has been injected, production is immediately resumed by recovering fluids including solvent and oil from the formation via the second flow path in the production well until the amount of solvent in the produced fluid has decreased to a value less than 12 percent by volume. The sequence of solvent injection followed by fluid production is continued for a plurality of cycles until there is water breakthrough at the production well.

6 Claims, 3 Drawing Figures

SOLVENT PUSH-PULL PROCESS FOR IMPROVING VERTICAL CONFORMANCE OF STEAM DRIVE PROCESS

FIELD OF THE INVENTION

The present invention pertains to a steam drive process for recovering viscous oil from a subterranean, viscous oil-containing formation. More particularly, the present invention involves an improved steam drive and recovery method utilizing a solvent push-pull process at the production well which increases the vertical conformance of the steam process.

BACKGROUND OF THE INVENTION

Many oil reservoirs have been discovered which contain vast quantities of oil, but little or no oil has been recovered from many of them because the oil present in the reservoir is so viscous that it is essentially immobile at reservoir conditions, and little or no petroleum flow will occur into a well drilled into the formation even if a natural or artificially induced pressure differential exists between the formation and the well. Some form of supplemental oil recovery must be applied to these formations which decreases the viscosity of the oil sufficiently that it will flow or can be dispersed through the formation to production well and therethrough to the surface of the earth. Thermal recovery techniques are quite suitable for viscous oil formations, and steam flooding is the most successful thermal oil recovery technique yet employed commercially.

Steam may be utilized for thermal stimulation for viscous oil production by means of a steam drive or steam throughput process, in which steam is injected into the formation on a more or less continuous basis by means of an injection well and oil is recovered from the formation from a spaced-apart production well. While this process is very effective with respect to the portion of the recovery zone between the injection well and production well through which the steam travels, poor vertical and horizontal conformance is often experienced in steam drive oil recovery processes. By vertical conformance, it is meant the portion of the vertical thickness of a formation through which the injected steam passes. A major cause of poor vertical conformance is caused by steam, being of lower density than other fluids present in the permeable formation, migrating to the upper portion of the oil formation to the remotely located production well. Once steam channeling has occurred in the upper portion of the formation, the permeability of the steam-swept zone is increased due to the desaturation or removal of oil from the portion of the formation through which steam has channeled. Thus subsequently-injected steam will migrate almost exclusively through the steam-swept channel and very little of the injected steam will move into the lower portions of the formation, and thus very little additional oil from the lower portion of the formation will be produced. While steam drive processes effectively reduce the oil saturation in the portions of the formation through which they travel by a significant amount, a large portion of the recovery zone between the injection and production systems is not contacted by steam and so a significant amount of oil remains in the formation after completion of the steam drive oil recovery process. The severity of the poor vertical conformance problem increases with the thickness of the oil formation and with the viscosity of the oil contained in the formation.

In view of the foregoing discussion, it can be appreciated that there is a substantial, unfulfilled need for a method of conducting a well-to-well throughput steam injection oil recovery method in a manner which results in improved vertical conformance.

SUMMARY OF THE INVENTION

The process of the present invention involves an improved steam drive oil recovery process with at least one injection well and at least one spaced-apart production well for injecting steam into the formation and recovering oil from the formation wherein a solvent push-pull treatment is commenced in the lower portion of the formation adjacent to the production well once there is a breakthrough of steam at the producing well. The injection well is in fluid communication throughout the full or a substantial amount of the vertical thickness of the oil formation or with the lower portion of the formation. The production well is completed with two separate flow means, one between the surface and the lower portion of the formation, and the other being in communication with the upper portion of the formation. Steam is injected into the injection well and oil is recovered from the production well until steam breakthrough at the production well occurs. At this time, production is terminated, and a solvent injection-production process is applied by the flow path of the production well in communication with the lower portion of the formation. This process is applied simultaneously with the steam drive process in a series of repetitive cycles throughout the entire time that the steam drive sequence is being applied. The solvent push-pull process comprises injecting a predetermined volume of solvent into the lower portion of the formation or until the injection pressure rises to a predetermined level which should be less than the pressure which will cause fracture of the formation and/or overburden formation. The volume of solvent injected is from 10 to 50 and preferably from 10 to 20 barrels of solvent per foot of formation with which the lower portion of the production well is in fluid communication. Once the predetermined volume of solvent has been injected, or when the predetermined pressure has been reached, solvent injection is stopped and fluid production is taken from the bottom of the formation. Oil and solvent flow from the bottom of the formation back into the flow path in fluid communication with the lower portion of the producing well and production is continued until the amount of solvent in the produced fluids has decreased to a value less than 12 percent by volume. Solvent injection is again applied followed by another period of production of solvent and oil. The solvent push-pull cycles are repeated until there is a breakthrough of steam or water in the lower portion of the formation. The solvent push-pull process promotes the sweeping action of the steam into the lower portion of the formation thereby stimulating the recovery of oil in that zone which would not be recovered in a conventional steam drive process.

DESCRIPTION OF THE PREFERRED EMBODIMENTS

Figure 1:
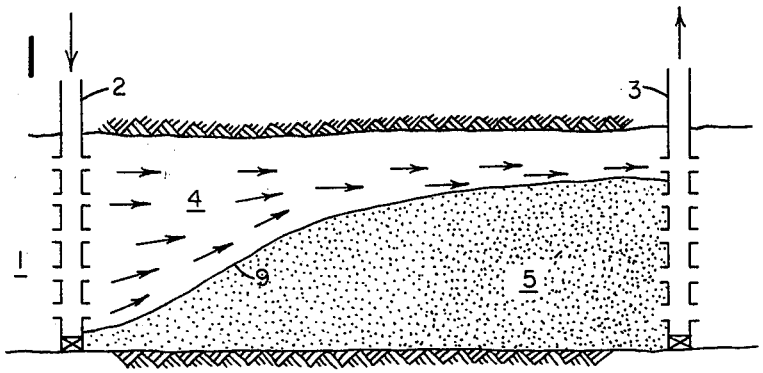
FIG. 1 illustrates a subterraneous formation penetrated by an injection well and a production well being employed in a state-of-the-art steam drive oil recovery method, illustrating how the injected steam migrates to the upper portion of the formation as it travels through the recovery zone within the formation and between the injection well and production well, thus bypassing a significant amount of oil in the recovery zone.

The problem of steam override for which the process of our invention represents a solution may best be understood by referring to the attached drawings, in which FIG. 1 illustrates how a relatively thick, viscous oil formation 1 is penetrated by an injection well 2 and a production well 3 is used for a conventional steam drive oil recovery process. Steam is injected into well 2, passes through the perforations in well 2 into the viscous oil formation. Conventional practice is to perforate or establish fluid flow communications between the well and the formation throughout the full vertical thickness of the formation, both with respect to injection well 2 and production well 3. Not withstanding the fact that steam is injected into the full vertical thickness of the formation, it can be seen that steam migrates both horizontally and in an upward direction as it moves through the formation between injection well 2 and production well 3. The result is the creation of a steam-swept zone 4 in the upper portion of the formation and zone 5 in the lower portion of the formation through which little or no steam has passed. Once steam breakthrough at production well 3 occurs, continued injection of steam will not cause any steam to flow through zone 5, because (1) the specific gravity of the substantially all vapor phase steam is significantly less than the specific gravity of the petroleum and other liquids present in the pore spaces of the formation, and so gravitational effects will cause the steam vapors to be confined exclusively in the upper portion of the formation, and (2) steam passage through the upper portion of the formation displaces and removes petroleum from that portion of the formation through which it travels, and desaturation of the zone increases the relative permeability of the formation significantly as a consequence of removing the viscous petroleum therefrom. Thus any injected fluid will travel more readily through the desaturated portion of the formation 4 than it will through the portion of the formation 5 which is near original conditions with respect to viscous petroleum saturation.

Figure 2:
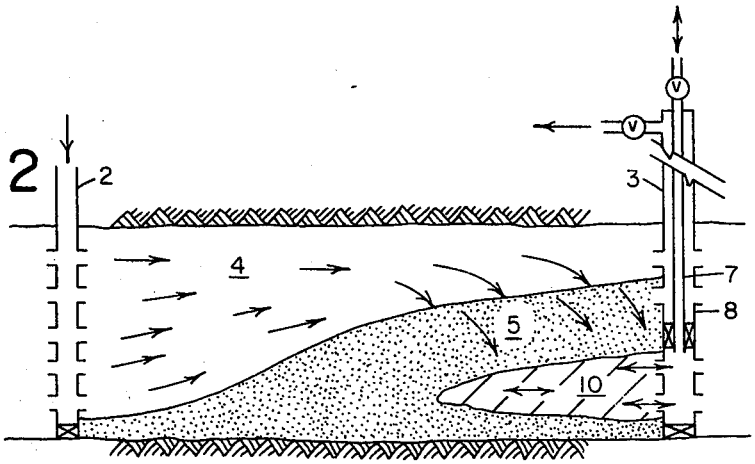
FIG. 2 illustrates the initial phase of my process wherein steam is injected into the injection well and simultaneously the lower portion of the formation adjacent the production well is subjected to a solvent push-pull treatment to draw steam into portions of the formation below the zone originally swept by steam.

The process of my invention is better understood by referring now to FIG. 2 wherein formation 1 is penetrated by spaced-apart injection and production wells 2 and 3, respectively. Injection well 2 is in fluid communication with the full vertical thickness of the formation. Production well 3 has two separate flow paths with one flow path in fluid communication with the upper portion of the formation and a second flow path in fluid communication with the lower portion of the formation. In the particular embodiment illustrated in FIG. 2, the annular space between casing 8 and tubing 7 of well 3 is used as the first communication path which is in fluid communication with the upper portion of the formation, while tubing 7 is used for the second communication path which is in fluid communication with the lower portion of the formation.

In the first step of the process of the present invention, a thermal recovery fluid comprising steam is injected into the formation by means of injection well 2. Steam enters the portion of the formation immediately adjacent to well 2 through all of the perforations in well 2, and initially travels through substantially all of the full vertical thicknesses of formation 1. As can be seen in FIG. 1, the steam vapors begin migrating in an upward direction toward the top of the reservoir because of the difference in specific gravity between steam vapor and formation fluids. This causes the characteristic slanting interface 9 between the steam-swept zone 4 and the unswept portion 5 of the formation 1. Thus by the time steam arrives at the upper perforations of production well 3, steam is passing through only a small fraction of the full vertical thickness of the formation. Oil is initially produced to the surface via the two communication paths of well 3 in fluid communication with the upper and lower portions of the formation.

The first step comprising injecting steam into injection well 2 and recovering fluids including oil from the upper and lower portion of the formation by means of production well 3 continues until the fluid recovered from the upper portion of the oil formation via the first flow path of the production well comprises an unfavorable amount of steam or water. Once there is sufficient steam or water breakthrough at well 3, production is terminated.

After production has been terminated, the flow path in the production well in fluid communication with the upper portion of the formation is shut in and a solvent injection-production sequence or push-pull process is applied to the lower portion of the formation adjacent the producing well by means of the flow path which communicates from the surface to the lower portion of the producing well while continuing injection of steam into the injection well. This sequence as illustrated in FIG. 2. comprises injecting a predetermined amount of solvent into the lower portion of the formation via the flow path which communicates from the surface to the lower portion of the producing well. Tubing 7 of well 3 is used for this purpose in the embodiment depicted in FIG. 2. The type of solvent injected into the lower portion of the formation is preferably a hydrocarbon which is liquid at formation temperature and injection pressure. Suitable solvents include light hydrocarbons such as a $C_4$–$C_{10}$ hydrocarbons, or a commercial blend such as natural gasoline, naphtha, light crude oil, partially refined tar generally known as syncrude, etc.

As the solvent is injected into the lower portion of the formation it fingers into zone 10 of the formation and dissolves the viscous oil, thus lowering its viscosity and thereby increasing its mobility. After a predetermined amount of solvent is injected into the formation which is from 10 to 50 and preferably from 10 to 20 barrels of solvent per foot of formation thickness with which the lower portion of the production well is in fluid communication, production is immediately resumed by recovering fluids including oil and solvent from the lower portion of the formation via the flow path in communication therewith.

During injection of the solvent it is necessary to monitor the injection pressure so that this pressure does not increase to the point which will cause fracture of the formation and/or the overburden, if the value of this pressure is known. Therefore, in some instances it is desirable to inject solvent for a fixed period of time.

When solvent injection is terminated and production of solvent and oil from the solvent-swept zone 10 is begun through well 3 via the flow path in fluid communication with the lower portion of the formation, the flow rate is usually quite high at first but declines rapidly as the drive pressure declines. Production is continued until the percentage of solvent of the fluid being produced decreases to a predetermined level, preferably to a value less than 12 percent by volume. The sequence of solvent injection followed by fluid production is then continued for a plurality of cycles until the fluid being recovered from the production well contains an unfavorable amount of steam or water. Generally, the amount of solvent in the production fluid at the termination of each production step will gradually decrease within the specified range as the cycles of solvent injection-fluid production increase.

Figure 3:
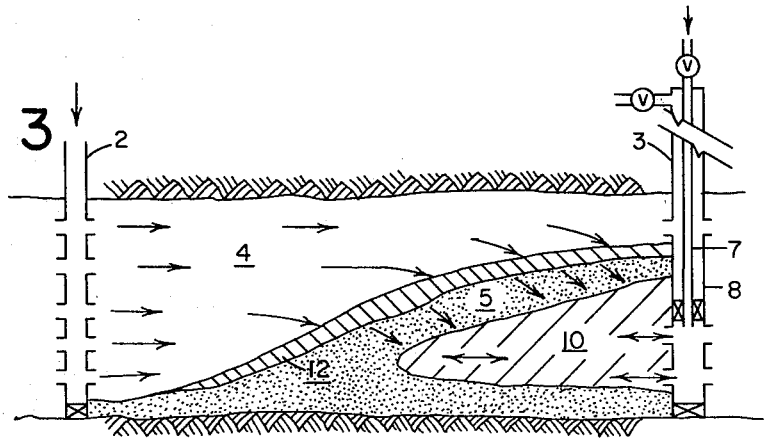
FIG. 3 illustrates how after a plurality of solvent push-pull treatments, the solvent-swept zone expands and additional portions of the formation are swept by steam.

The above-described sequence of solvent injection followed by fluid production while simultaneously injecting steam into well 2 draws the steam away from the original steam-swept zone 4 so that it invades an additional portion 12 of the formation 5 located below the original steam-swept zone, as shown in FIG. 3. As the solvent injection-production cycles are repeated, the solvent-swept zone expands toward the injection well 2 and steam passes deeper into portion 5 of the formation. The amount of solvent injected for each cycle is from 10 to 50 and preferably 10 to 20 barrels of solvent per foot of formation thickness being treated and each fluid production step is terminated when the amount of solvent in the produced fluids decreases to a value less than 12 percent by volume. The solvent injection-production cycles are continued until steam or steam condensate production at well 3 via tubing 7 occurs to a unfavorable extent.

In another embodiment of the invention, the above-described process may be employed in those formations where the production well does not initially have two separate flow paths in fluid communication with the upper and lower portions of the formation. For example, the injection well and production well may be in fluid communication with a substantial portion or the entire portion of the formation. In such a case, steam is injected into the injection well and fluids including oil are recovered from the production well until the presence of steam and steam condensate in the production fluid occurs to a unfavorable extent. Production is then terminated and the upper portion of the production well in fluid communication with the formation is closed-off by any convenient means. One method is to spot sufficient cement in the upper portions of the production well so as to completely fill and block-off communications between that portion of the well and the formation. The solvent push-pull treatment is then initiated while simultaneously injecting steam into the injection well in the manner described above with injection of the solvent into the production well which is in fluid communication with the lower portion of the formation. Steam injection and the simultaneous sequence of solvent injection followed by production are continued until there is a substantial breakthrough of steam or steam condensate at the production well.

In still another embodiment of the invention, the above-described process may be employed in those formations wherein the injection well is in fluid communication with the lower portion of the formation.

It will be apparent to those skilled in the art that the present method results in an appreciable increase in the vertical sweep efficiency of a steam drive process, thereby significantly increasing the recovery of oil from oil-bearing formations. Various changes and modifications may be made in the method without departing from the spirit of the invention. All such modifications and changes coming within the scope of the invention of the appended claims are intended to be included herein.

I claim:

1. A method for recovering viscous oil from a subterranean, permeable, viscous oil-containing formation, said formation being penetrated by at least two wells, one injection well and one production well, said wells being in fluid communication with a substantial portion of the oil formation, comprising:

(a) injecting steam into the injection well and recovering fluid including oil from the formation by the production well until the fluid being recovered from the production well comprises an unfavorable amount of steam or water;

(b) thereafter closing off the fluid communication between the production well and at least a portion of the upper part of the oil formation while maintaining fluid communication with the lower portion of the formation;

(c) thereafter injecting a predetermined volume of a solvent into the formation via the fluid communication between the production well and the lower portion of the formation while simultaneously continuing injection of steam into the injection well;

(d) recovering fluids including solvent and oil from the lower portion of the formation through the production well until the fluid being recovered from the production well comprises a predetermined amount of solvent; and (e) repeating steps (c) and (d) for a plurality of cycles until the fluid being recovered from the production well comprises an unfavorable amount of steam or water.

2. A method as recited in claim 1 wherein the solvent of step (c) is a light hydrocarbon selected from the group consisting of $C_4$ to $C_{10}$ aliphatic hydrocarbons, natural gasoline, naphtha, light crude oil, partially refined tar generally known as syncrude and mixtures thereof.

3. A method as recited in claim 1 wherein fluid production from the production well during step (d) is continued until the amount of solvent in the produced fluids has decreased to a value less than 12 percent by volume.

4. A method as recited in claim 1 wherein the volume of solvent injected during step (c) is from 10 to 50 barrels per foot of formation thickness with which the lower portion of the production well is in fluid communication.

5. A method as recited in claim 1 wherein the volume of solvent injected during step (c) is from 10 to 20 barrels per foot of formation thickness with which the lower portion of the production well is in fluid communication.

6. A method as recited in claim 1 wherein said injection well is in fluid communication with the lower portion of the formation.

* * * * *